US008597441B2

(12) United States Patent
Sommer et al.

(10) Patent No.: US 8,597,441 B2
(45) Date of Patent: Dec. 3, 2013

(54) METHOD FOR PRODUCING PARTIALLY HARDENED STEEL COMPONENTS

(75) Inventors: Andreas Sommer, Schwäbisch Gmünd (DE); Dieter Hartmann, Mutlangen (DE); Tobias Hägele, Schwäbisch Gmünd (DE)

(73) Assignee: Voestalpine Metal Forming GmbH, Krems an der Donau (AT)

( * ) Notice: Subject to any disclaimer, the term of this patent is extended or adjusted under 35 U.S.C. 154(b) by 64 days.

(21) Appl. No.: 13/258,085

(22) PCT Filed: Mar. 6, 2010

(86) PCT No.: PCT/EP2010/054019

§ 371 (c)(1), (2), (4) Date: Dec. 12, 2011

(87) PCT Pub. No.: WO2010/109012

PCT Pub. Date: Sep. 30, 2010

(65) Prior Publication Data

US 2012/0097298 A1 Apr. 26, 2012

(30) Foreign Application Priority Data

Mar. 26, 2009 (DE) ..... 10 2009 015 013

(51) Int. Cl.
*C21D 8/02* (2006.01)
*C21D 6/00* (2006.01)

(52) U.S. Cl.
USPC ..... 148/640; 148/643; 148/644; 148/647

(58) Field of Classification Search
USPC ..... 148/640, 643, 644, 647
See application file for complete search history.

(56) References Cited

U.S. PATENT DOCUMENTS 4,506,822 A * 3/1985 Hammersand et al. ..... 228/200

FOREIGN PATENT DOCUMENTS

DE 19743802 C2 9/2000
DE 20014361 U1 10/2000

(Continued)

OTHER PUBLICATIONS

Machine-English translation of DE 102006018406 A1, Braun, Elisabeth, Sep. 13, 2007.*

(Continued)

*Primary Examiner* — Deborah Yee
(74) *Attorney, Agent, or Firm* — Setter Roche LLP

(57) ABSTRACT

The invention relates to a method for producing partially hardened steel components in which a blank is subjected to a temperature increase that is sufficient for a quench-hardening and after reaching a desired temperature, the blank is transferred to a forming tool in which the blank is quench-hardened or the blank is cold-formed and the component obtained by the cold-forming is then subjected to a temperature increase. During the heating of the blank or component, absorption masses rest against and/or are spaced with a small gap apart from regions that are intended to have a lower hardness and/or higher ductility; with regard to its expansion and thickness, its thermal conductivity, and its thermal capacity and/or with regard to its emissivity, the absorption mass is dimensioned so that the thermal energy acting on the component in the region to remain ductile flows through the component into the absorption mass.

10 Claims, 6 Drawing Sheets

Fig. 1

(56) References Cited

FOREIGN PATENT DOCUMENTS

| | | | |
|---|---|---|---|
| DE | 10162415 | A1 | 7/2003 |
| DE | 10212819 | A1 | 10/2003 |
| DE | 102006018406 | A1 | 9/2007 |
| EP | 0816520 | B1 | 10/2001 |
| EP | 1536025 | A1 | 6/2005 |

OTHER PUBLICATIONS

Machine-English translation of DE 10162415 A1, Siemplekamp pressen systeme GM (DE), Jul. 3, 2003.*

English Translation of the International Preliminary Report of Patentability for PCT application No. PCT/EP2010/054019, dated Dec. 15, 2011 issued by the International Bureau of WIPO, 8 pages.

* cited by examiner

| Company | Plot | Folder | Record | Chan. | Chan. no. | Type | Record start | Record size | Remarks | Operator |
|---|---|---|---|---|---|---|---|---|---|---|
| | | NEW FOLDER | 4 | 2 | Channel 2 | deg C | 11 Feb 2009 (2:21:04 pm) | 1288 samples at 500 ms | | |

METHOD FOR PRODUCING PARTIALLY HARDENED STEEL COMPONENTS

FIELD OF THE INVENTION

The invention relates to a method for producing partially hardened steel components.

BACKGROUND OF THE INVENTION

It is known to harden and produce steel components by heating a flat blank to an austenitization temperature, forming it, and then rapidly cooling it.

It is also known to heat already cold-formed components and then to cool and harden them in a tool that corresponds to the final shape of the component.

To obtain hardened components with regions of different hardnesses, it is among other things known to produce the components from laser-welded blanks, with the laser-welded blanks being composed of steels of different qualities and hardenabilities. A steel that can be hardened through a corresponding temperature increase is thus situated adjacent to a steel that either cannot be hardened at these temperatures, or is not hardenable in general.

DE 197 43 802 C2 has disclosed a method for producing a metallic formed component in which the metallic formed component is intended to have regions with a higher ductility; the formed component is composed of a hardenable steel and in a first step, partial regions of a blank are brought to a temperature of 600° C. to 900° C. in a period of less than 30 seconds, after which the heat-treated blank is formed into the formed component in a pressing tool and then the formed component is cooled in the pressing tool, thus partially hardening it.

In another embodiment described in this prior publication, a formed component is first homogenously heated to a temperature that is necessary for hardening and then the blank undergoes its final forming in the pressing tool, turning it into the formed component. The required hardening takes place in the pressing tool. The homogeneously hardened component is then placed onto a conveyor and oriented in position by holding devices. On this conveyor, the formed components pass through a heating device in which the regions that are to have a higher ductility are brought to a temperature of 600° C. to 800° C. in an extremely short time by an inductor and are then cooled slowly enough that a renewed hardening does not occur and instead, these parts are in turn ductile. This method has the disadvantage that it requires multiple steps and is also energy intensive.

DE 200 14 361 U1 has disclosed a B-pillar for a motor vehicle, which is composed of a longitudinal profile of steel, in which the longitudinal profile is intended to have a first longitudinal section, which has a predominantly martensitic material structure and a strength of greater than 1,400 $N/mm^2$, and a second longitudinal section, which has a higher ductility and a predominantly ferritic/pearlitic material structure and a strength of less than 850 $N/mm^2$. To establish these different regions, it is known from this prior publication to insulate the longitudinal profile in the regions in which the longitudinal profile is to remain soft, to protect them from the heat of the furnace by placing insulating elements so that they encompass and cover the profile. As a result, these regions are supposed to experience no significant heating so that the total temperature increase in these sections is significantly below the austenitization temperature.

In another embodiment, the forming blank is first completely and homogeneously heated to an austenitization temperature and during the transfer or transport of the blank into the hardening tool, is brought to a temperature well below the austenitization temperature through targeted, not too abrupt cooling, so that no purely martensitic structure is produced during the hot forming. This method has the disadvantage that the targeted cooling of a blank or preformed component increases cycle times and requires additional processing steps. With an insulation from the heat of the furnace, it is disadvantageous that setting the insulation into place and removing it afterward entail additional steps that increase the cycle time and increase process costs.

EP 0 816 520 B1 has disclosed a press-hardened component and a method for the hardening thereof. This component is intended to include hardened and unhardened regions and the method uses an inductor to harden the component or profile by heating the component at least partway to an austenitization temperature and after being treated by the inductor, the component is conveyed to a cooling device, for example equipped with a water jet, which performs the rapid cooling necessary for hardening. Experiments have shown that this method is very expensive and results in extremely protracted cycle times; experiments have also shown that this method results in extremely powerful distortion of components. This is also the reason that this method is not used in actual practice.

The object of the invention is to create a method for producing partially hardened steel components which is simple and economically feasible while achieving high process reliability and favorably predictable hardness values in different regions.

SUMMARY OF THE INVENTION

According to the invention, during the heating, an absorption mass rests against the regions that are to undergo little or no hardening. In the context of the invention, the expression "rests against" is also understood to include an arrangement in which there is a small distance between the absorption mass and the blank, in particular a distance of 0.5 to 2 mm.

The absorption mass is a "cold" mass that rests against the hot blank during the furnace process. This mass extracts energy from the blank through the contact surface or through radiation across the narrow gap. In the context of the invention, thermal transmission includes thermal conduction through the contact surface in a direct contact of the absorption mass with the blank as well as thermal radiation across a short distance. The mass thus partially absorbs the energy of the blank, which is conveyed through the furnace. Consequently, a "cold" mass resting against the sheet is also referred to hereinafter as an absorption mass. With the invention, therefore, a thermal flow takes place from the furnace chamber, through the sheet metal of the component, and into the absorption mass. No insulation occurs.

According to the invention, during the heating process, parts of the components are not brought to the austenitic start temperature or are brought to it only briefly. As a result, the material in these regions does not transform into austenite or does so only partially and therefore cannot transform into martensite in these regions during the press process (press-hardening). The regions that do not transform into martensite due to the prior heat treatment in the press-hardening have a significantly lower strength than the regions that were brought to the austenitic start temperature during the heat treatment and then hardened in the press.

This partial austenitization/partial non-austenitization is achieved by placing the absorption mass partially against the component at the beginning of the heat treatment (before the component travels into the furnace). The absorption mass rests against the component and partially emulates the shape of the component. During the transport through the furnace, this relatively large absorption mass is heated far less powerfully than the component. As a result, energy is extracted from the component against the contact surface through the partial contact with the mass (energy flow always travels from hot to cold). In these regions, the component is therefore heated much more slowly and to a lower temperature than in the remaining regions against which the mass does not rest.

The soft regions can be produced in a targeted fashion by the absorption mass resting against them. With the same contact area, but different thicknesses of the absorption mass (even through its expansion), it is possible to produce different strengths. It is thus possible to set virtually any strength between 500 and 1,500 MPa merely by varying the thickness of the absorption mass or of the material of which the absorption mass is composed (even through its expansion). The strength transition zone between hard and soft material is approx. 20-50 mm, in particular 20 to 30 mm.

In addition, air gaps can be provided, particularly in the edge region, to make the hardness transition even wider.

To make this process reliable, it is necessary to make sure that the absorption mass, before it returns to the furnace, always has an appropriate, constant low temperature. In the series production process, this can be accomplished in different ways during the return travel of the furnace supports.

A large, precisely adjustable, and homogeneous transition zone from hard to soft results, for example, in the fact that in the event of a crash, the component's transition zone from hard to soft can homogeneously absorb the resulting stresses and "softly" absorb shocks, thus preventing the component from being partially overloaded and possibly fracturing during the crash, resulting in component failure.

With certain component geometries, a larger transition zone also prevents the component from fracturing in the region of welding points executed during body framing.

It is also possible to use exactly defined ductile regions in the vicinity of welding points to exert a precise, accurately positioned influence on the behavior of the component during a crash.

To reduce the heating of the absorption mass by the rest of the furnace chamber atmosphere, heat shielding plates can be provided on the side of the absorption mass opposite from the component. These heat shielding plates can be made of various materials, in particular ceramic or metallic materials.

Also, appropriately selected emissivities (surface condition, plating, coating) can be used to selectively control the thermal absorption of the absorption mass and/or heat shielding plates due to radiation emanating from the furnace chamber. It is also possible to selectively influence the thermal absorption of the absorption mass due to radiation from the blank.

The invention will be explained below in conjunction with the drawings.

DETAILED DESCRIPTION OF THE PREFERRED EMBODIMENTS

According to the invention, in a first embodiment of the invention, an absorption mass, for example in the form of a box-shaped component made of steel, is placed onto a sheet that is to be austenitized.

Any form of heat-resistant metals such as Ampco alloys and steels, especially also including heat-resistant steels, but also ceramic components can be used for the absorption mass. The thermal conductivity and thermal capacity are decisive criteria for their usability. The absorption mass in this case has an outer form or contour, which corresponds to the regions that should remain softer and is possibly also matched to the shape of the formed part. In particular, the absorption mass can naturally also have a shape that differs from the simple box-shaped form, having a complex irregular shape, even one with recesses.

Figure 1:
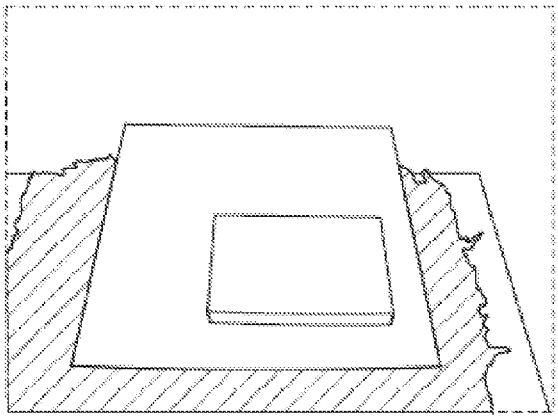
FIG. 1 shows a blank with an absorption mass placed onto it.
Figure 2:
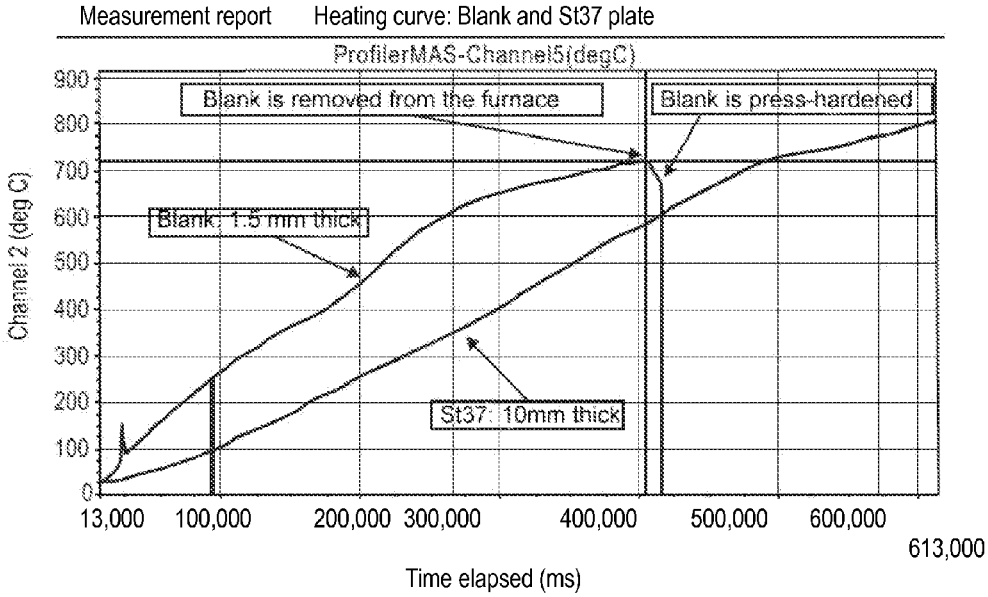
FIG. 2 shows the heating curve of the blank and the absorption mass placed onto it.

FIG. 2 shows a heating curve for the blank and a heating curve for the absorption mass.

It is apparent that the absorption mass heats up with a significant delay and when removed from the furnace to be press hardened, whereas the blank in the uncovered region has a temperature of 720° C., the absorption mass and therefore also the sheet region underlying it has a temperature of less than 600° C., which does not result in a hardening, even with a rapid subsequent cooling.

Figure 3:
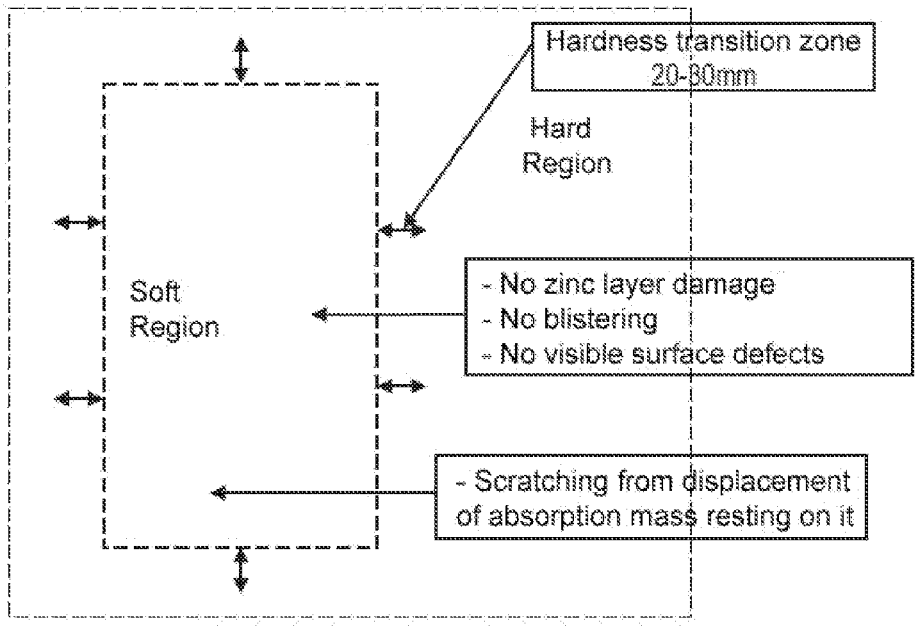
FIG. 3 shows the blank after the removal of the absorption mass and a completed cooling.

After the removal of the absorption mass and a cooling, the blank has the appearance depicted in FIG. 3, which shows that in the region in which the absorption mass was resting, the metal has an essentially unchanged bright metallic appearance. The hardness transition zone from the hard region to the soft region underlying the absorption mass is 20 mm to 50 mm, in particular 20 mm to 30 mm.

Figure 4:
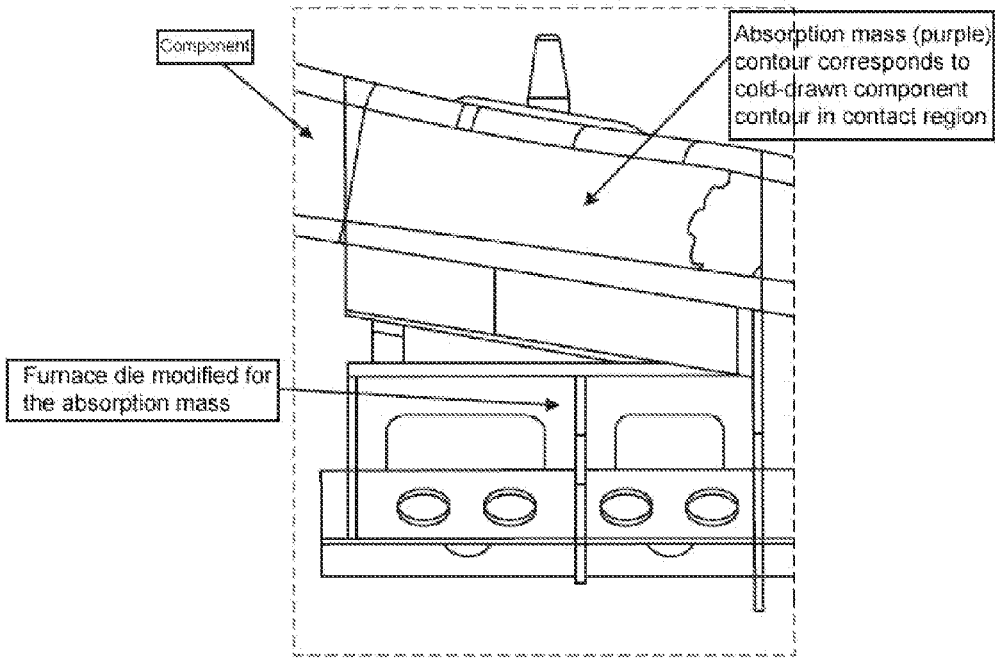
FIG. 4 schematically depicts an absorption mass, which has been placed onto a finished formed part.
Figure 5:
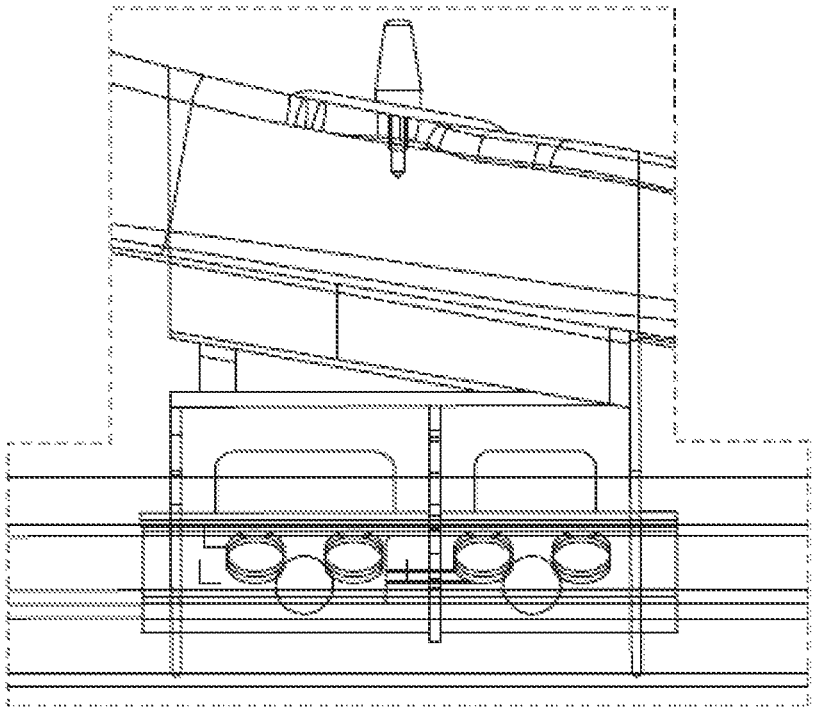
FIG. 5 is a partially sectional view of the depiction in FIG. 4.
Figure 6:
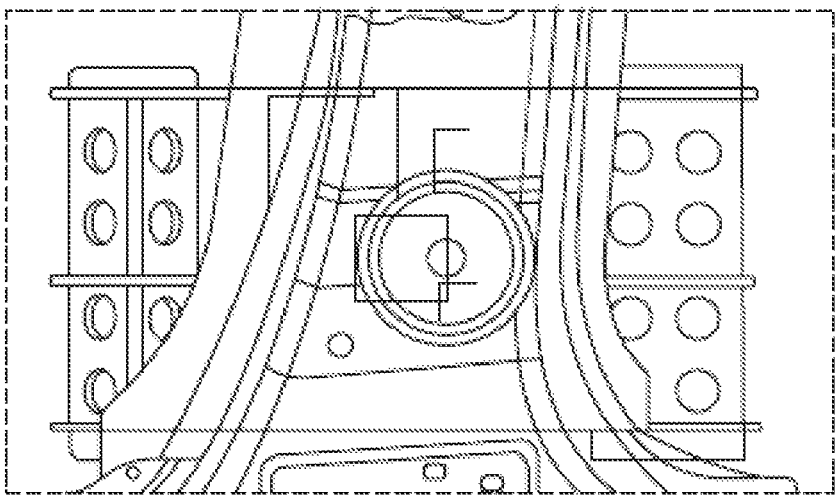
FIG. 6 is a top view of the depiction in FIG. 4.
Figure 7:
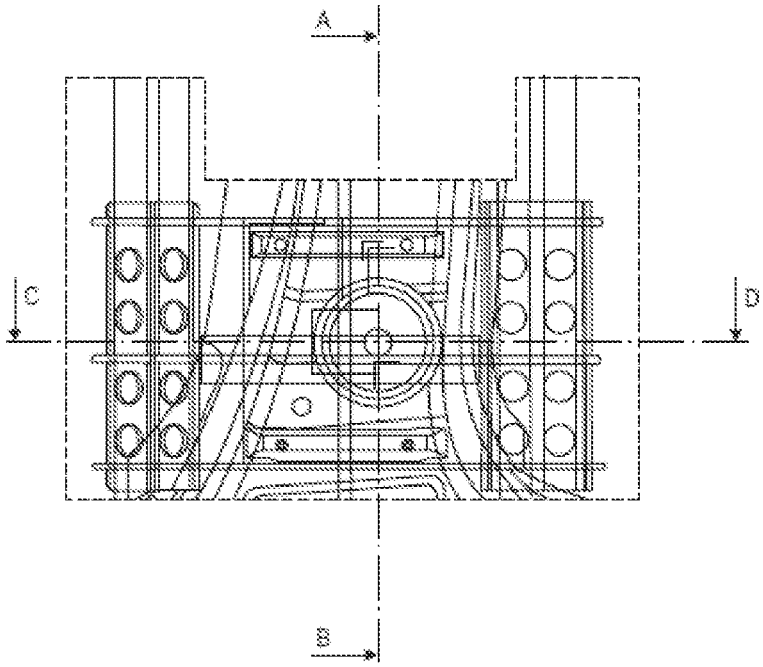
FIG. 7 is a partially sectional view of the depiction in FIG. 6.
Figure 8:
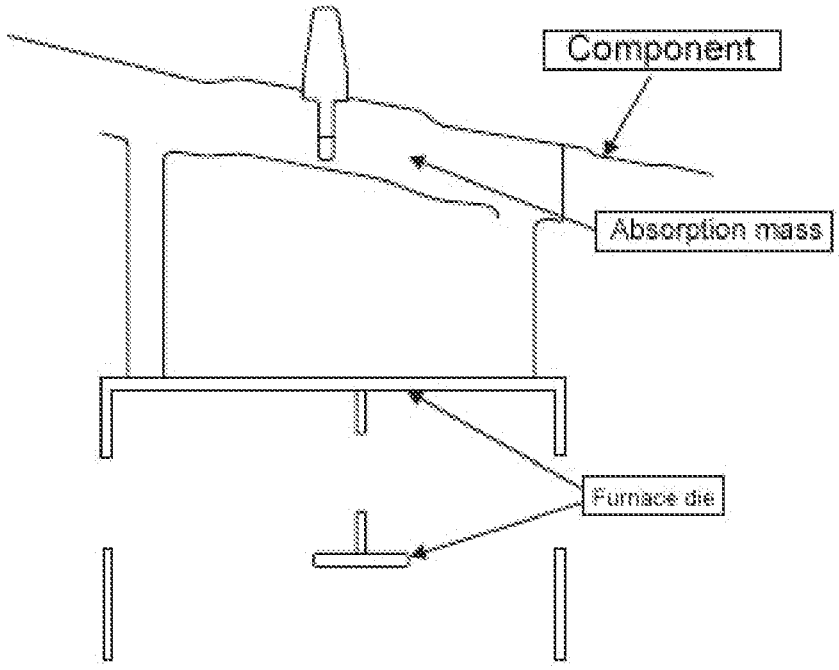
FIG. 8 is a sectional view of the depiction in FIG. 4.
Figure 9:
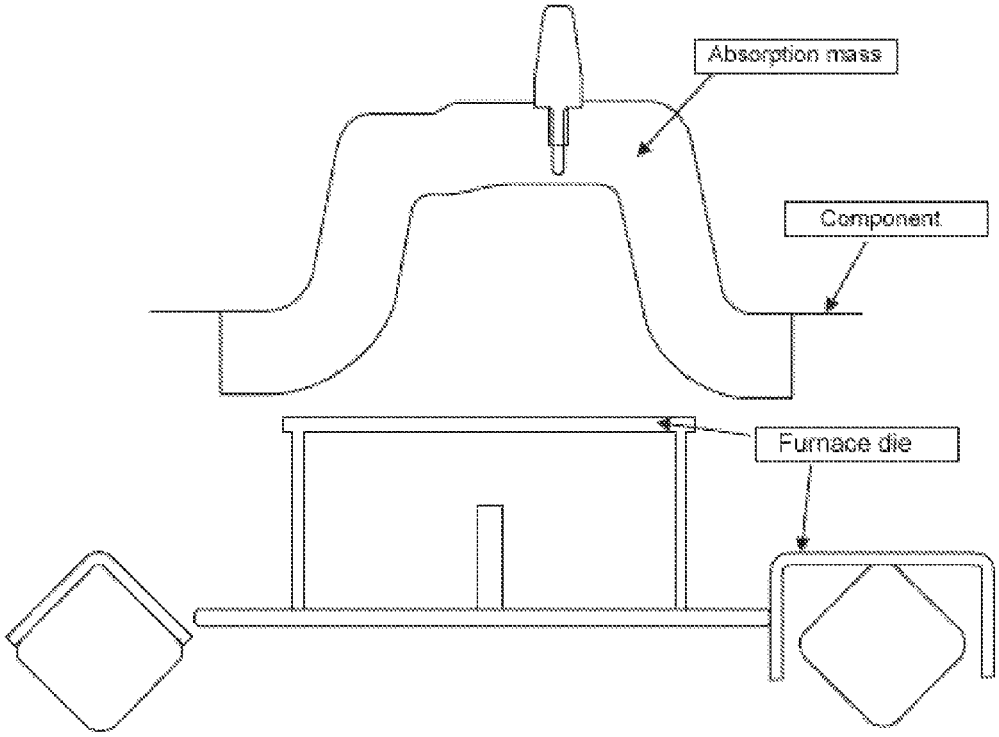
FIG. 9 shows another embodiment in which the finished molded component is resting against a correspondingly shaped absorption mass.

In another advantageous embodiment, the absorption mass has a shape that is matched to the shape of a finished formed workpiece. In order to harden it, this finished formed workpiece is then heated and after the heating, is cooled in a forming tool without significant distortion. During the heating, as shown in FIG. 4, either the absorption mass is placed onto the component lying in the furnace in order to permit the underlying sheet metal to leave the furnace at a lower temperature or, as shown in FIG. 9, the component is placed so that it partially rests on the absorption mass. The effect on the heating is the same.

Figure 10:
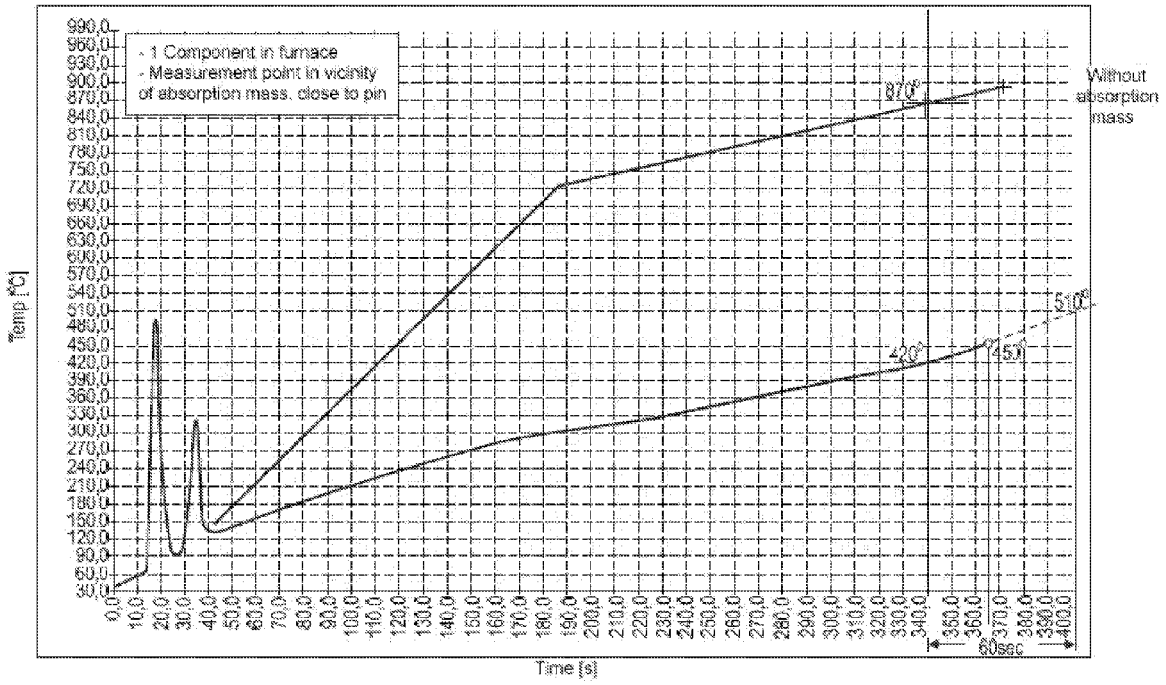
FIG. 10 shows two heating curves of a component, where the temperature has been measured in the region of the underlying absorption mass and in a region not occupied by the absorption mass.

FIG. 10 shows a graph in which temperatures were measured in a component during the heating, i.e. once in the region of an underlying absorption mass and once in a region in which no absorption mass was present. The graph clearly shows that the temperature of the component above the absorption mass is in a non-critical range, which means that no hardening will occur there due to the significantly reduced heating.

As explained above, the absorption mass can be so embodied so that either a flat blank or an already preformed component, in the regions that are to remain softer, rests on this absorption mass, possibly even being spaced apart from it in some regions with a slightly larger air gap, in particular an air gap of 4 mm to 10 mm, in order to produce hardness transitions.

For example, a preferred use of the absorption mass is the production of rounded or circular softer regions on a component or blank, particularly in the flange region in places where a joining procedure is to be carried out. This is particularly advantageous for welded connections because it has turned out that when heat treating zinc-coated highly hardenable sheet steels, the hardening partially changes the surface of the zinc coating by means of oxide deposits, reducing its weldability. If these regions with absorption masses are left soft due to the presence of an absorption mass, in particular an absorption mass that is embodied as elongated, for example in the region of the flange, and has rounded column-shaped projections, on which the component rests, then regions can be produced in which the zinc surface is not disadvantageously changed, thus retaining a very good weldability in these regions. This is advantageous for mechanical reasons because the welded connections remain even more ductile in these softer regions and allow so-called unbuttoning fractures to occur, thus in addition achieving a fracture pattern that is preferred in the industry.

After the furnace process, the absorption mass can be actively cooled by a cooling section on the return route of the furnace supports. Before the absorption mass travels into the furnace again, this cooling section ensures that the temperature of the mass always has a constant low temperature. Different cooling media can be used to cool the absorption mass, for example compressed air or nitrogen.

The furnace supports can be modified in such a way that the absorption mass can be placed onto and removed from the furnace supports by a robot or a suitable mechanism. This can be implemented as follows in the series production process. The return of the furnace supports is routed over the furnace. In this case, the furnace supports always remain in the same place for approximately 20 seconds. A robot or suitable mechanism can be positioned there; it takes the hot absorption mass from its holder and then puts a cold absorption mass in its place. The hot absorption mass can be transferred to an (active or passive) cooling circuit, which cools the hot absorption mass until it is reused. This ensures that the absorption mass always extracts the same amount of energy from the component in the furnace during the furnace process.

The partial austenitization can be followed by a partial press-hardening.

The advantages of the invention are:

The component geometry is reliably ensured because in the press-hardening, the component is kept in the pressing tool during the cooling.

No increase in cycle times in the press-hardening

No extra tempering required

Any strength between 500 MPa and 1,500 MPa can be selectively achieved on the furnace supports, depending on the absorption mass.

Manageable investment costs

The size of each ductile region can be freely varied depending on the application.

Relatively narrow hardness transition zone between hard and soft

In order to avoid producing surface contamination or blistering on the component surface due to the absorption mass resting against it, it is necessary to make sure that there is no contamination on the contact surface of the absorption mass and that there is no scale build-up on it due to the constant heating and cooling process. Either a suitable material must be used as the absorption mass or a corresponding surface coating is advantageous.

The invention claimed is:

1. A method for producing partially hardened steel components, comprising:

subjecting a blank composed of a hardenable sheet steel to a temperature increase that is sufficient for a quench-hardening by heating the blank in a furnace chamber;

during the heating of the blank for the purpose of increasing the temperature to a temperature required for the hardening, resting at least one absorption mass against and/or spacing at least one absorption mass with a small gap apart from regions that are intended to have a lower hardness and/or higher ductility;

providing shielding plates on one or more surfaces of the absorption mass that are oriented toward the furnace chamber, wherein the shielding plates shield the absorption mass from radiation emanating from the furnace chamber;

after reaching the temperature required for the hardening, and optionally after a holding time sufficient for the hardening, transferring the blank to a forming tool; and forming the blank into a component and at the same time quench-hardening the component;

wherein with regard to its expansion and thickness, its thermal conductivity, and its thermal capacity and/or with regard to its emissivity, the absorption mass is dimensioned so that thermal energy acting on the component in the region to remain ductile flows through the component into the absorption mass.

2. The method as recited in claim 1, wherein the absorption mass is composed of a heat-resistant metal, and at least one surface of the absorption mass is contoured so that the at least one surface rests against the blank or component and/or is spaced apart from the blank or component by a gap of 0.5 mm to 2 mm, or, in order to adjust hardness transition zones, is spaced apart from the blank or component in some areas by gaps of 4 to 10 mm.

3. The method as recited in claim 1, wherein the at least one absorption mass is situated on a support with which the blank or component is conveyed through the furnace chamber and as the support travels through the furnace chamber, the blank or component rests on the absorption mass or masses.

4. The method as recited in claim 1, further comprising controlling heat absorption of the absorption mass from the furnace chamber and/or from the component by adjusting the emissivities of the surface of the absorption mass.

5. The method as recited in claim 1, further comprising controlling thermal absorption of the shielding plates from the furnace chamber by adjusting the emissivities of the surface of the shielding plates.

6. A method for producing partially hardened steel components, comprising:

subjecting a blank composed of a hardenable sheet steel to a temperature increase that is sufficient for a quench-hardening by heating the blank in a furnace chamber;

during the heating of the blank for the purpose of increasing the temperature to a temperature required for the hardening, resting at least one absorption mass against and/or spacing at least one absorption mass with a small gap apart from regions that are intended to have a lower hardness and/or higher ductility;

providing shielding plates on one or more surfaces of the absorption mass that are oriented toward the furnace chamber, wherein the shielding plates shield the absorption mass from radiation emanating from the furnace chamber;

after reaching the temperature required for the hardening, and optionally after a holding time sufficient for the hardening, transferring the blank to a forming tool; and cold-forming the blank into a component and then subjecting the cold-formed component to a temperature increase, the temperature increase being carried out so that a component temperature required for a quench-hardening is reached, and then transferring the component into a tool in which the heated component is cooled and thus quench-hardened;

wherein with regard to its expansion and thickness, its thermal conductivity, and its thermal capacity and/or with regard to its emissivity, the absorption mass is dimensioned so that thermal energy acting on the component in the region to remain ductile flows through the component into the absorption mass.

7. The method as recited in claim 6, wherein the absorption mass is composed of a heat-resistant metal, and at least one surface of the absorption mass is contoured so that the at least one surface rests against the blank or component and/or is spaced apart from the blank or component by a gap of 0.5 mm to 2 mm, or, in order to adjust hardness transition zones, is spaced apart from the blank or component in some areas by gaps of 4 to 10 mm.

8. The method as recited in claim 6, wherein the at least one absorption mass is situated on a support with which the blank or component is conveyed through the furnace chamber and as the support travels through the furnace chamber, the blank or component rests on the absorption mass or masses.

9. The method as recited in claim 6, further comprising controlling heat absorption of the absorption mass from the furnace chamber and/or from the component by adjusting the emissivities of the surface of the absorption mass.

10. The method as recited in claim 6, further comprising controlling thermal absorption of the shielding plates from the furnace chamber by adjusting the emissivities of the surface of the shielding plates.

* * * * *

UNITED STATES PATENT AND TRADEMARK OFFICE

CERTIFICATE OF CORRECTION

PATENT NO. : 8,597,441 B2
APPLICATION NO. : 13/258085
DATED : December 3, 2013
INVENTOR(S) : Andreas Sommer et al.

It is certified that error appears in the above-identified patent and that said Letters Patent is hereby corrected as shown below:

On the Title Page, Item (22) should read

PCT Filed: Mar. 26, 2010

Signed and Sealed this
Second Day of September, 2014

Michelle K. Lee

Michelle K. Lee
*Deputy Director of the United States Patent and Trademark Office*